US011364400B2

(12) United States Patent
Krutskevych

(10) Patent No.: US 11,364,400 B2
(45) Date of Patent: Jun. 21, 2022

(54) SPRINKLER HEAD WITH A BULB HAVING AN EMBEDDED RFID CIRCUIT

(71) Applicant: MARIOFF CORPORATION OY, Vantaa (FI)

(72) Inventor: Nazar Krutskevych, Pomorske (PL)

(73) Assignee: MARIOFF CORPORATION OY, Vantaa (FI)

( * ) Notice: Subject to any disclaimer, the term of this patent is extended or adjusted under 35 U.S.C. 154(b) by 180 days.

(21) Appl. No.: 16/800,324

(22) Filed: Feb. 25, 2020

(65) Prior Publication Data

US 2020/0276464 A1 Sep. 3, 2020

(30) Foreign Application Priority Data

Mar. 1, 2019 (EP) ..... 19397506

(51) Int. Cl.

| | |
|---|---|
| ***A62C 37/11*** | (2006.01) |
| ***A62C 37/14*** | (2006.01) |
| ***A62C 37/50*** | (2006.01) |
| ***G08B 17/06*** | (2006.01) |
| ***G08B 25/00*** | (2006.01) |

(52) U.S. Cl.

CPC ..... *A62C 37/11* (2013.01); *A62C 37/14* (2013.01); *A62C 37/50* (2013.01); *G08B 17/06* (2013.01); *G08B 25/00* (2013.01)

(58) Field of Classification Search

CPC ..... A62C 37/11; A62C 37/14; A62C 37/50; G08B 17/06; G08B 25/00; G06K 19/0723

See application file for complete search history.

(56) References Cited

U.S. PATENT DOCUMENTS

| | | | | |
|---|---|---|---|---|
| 7,143,834 | B2 | 12/2006 | Dolan | |
| 7,633,393 | B2 * | 12/2009 | Bonne | G08B 5/36 340/572.1 |
| 8,002,046 | B2 | 8/2011 | Neeb et al. | |
| 8,668,023 | B2 | 3/2014 | Wilkins et al. | |
| 9,153,107 | B2 | 10/2015 | Austin | |
| 9,672,712 | B1 | 6/2017 | Akers | |
| 9,700,746 | B2 | 7/2017 | Bodemann | |
| 9,993,675 | B2 | 6/2018 | Groen et al. | |
| 10,092,785 | B2 | 10/2018 | Schmitt et al. | |
| 2004/0194976 | A1 | 10/2004 | Kretzschmar | |
| 2007/0075411 | A1 | 4/2007 | Tanigawa et al. | |
| 2015/0339568 | A1 | 11/2015 | Nekoogar et al. | |

(Continued)

FOREIGN PATENT DOCUMENTS

| | | | |
|---|---|---|---|
| AU | 604161 | B2 | 12/1990 |
| AU | 2010356228 | A1 | 9/2012 |

(Continued)

OTHER PUBLICATIONS

Yeoman, Mark; "RFID Tag Read Range and Antenna Optimization"; Oct. 8, 2014; Continuum Blue, discussing COMSOL Multiphysics RFID tag from Comsol, Inc.; pp. 1-4 (Year: 2014).*

(Continued)

*Primary Examiner* — Darren W Gorman
(74) *Attorney, Agent, or Firm* — Cantor Colburn LLP

(57) ABSTRACT

Disclosed is a sprinkler head having: a sprinkler body; a frangible sprinkler bulb connected to the body, the frangible sprinkler bulb including: a cylindrical wall; and an RFID circuit embedded in the cylindrical wall.

12 Claims, 2 Drawing Sheets

(56) References Cited

U.S. PATENT DOCUMENTS

| | | | |
|---|---|---|---|
| 2016/0354626 | A1 | 12/2016 | Mcnamara et al. |
| 2018/0200552 | A1 | 7/2018 | Wertsberger |
| 2018/0286218 | A1 | 10/2018 | Kitterman et al. |
| 2018/0361183 | A1 | 12/2018 | Tanklevski et al. |

FOREIGN PATENT DOCUMENTS

| | | | | |
|---|---|---|---|---|
| AU | 2015343181 | B1 | 6/2017 | |
| CA | 2911790 | A1 | 5/2016 | |
| CN | 1049994 | C | 3/2000 | |
| CN | 201489564 | U | 5/2010 | |
| CN | 101898018 | B | 6/2014 | |
| CN | 205391507 | U | 7/2016 | |
| EP | 3040913 | A1 | 7/2016 | |
| EP | 3134187 | B1 | 1/2018 | |
| EP | 3702003 | B1 * | 4/2021 | ..... A62C 37/11 |
| GB | 2521857 | A | 8/2015 | |
| IN | 201747000366 | A | 5/2017 | |
| JP | 2006115725 | A | 5/2006 | |
| JP | 05559199 | B2 | 7/2014 | |
| KR | 2009115096 | A | 11/2009 | |
| KR | 1702163 | B1 | 2/2017 | |
| WO | 0240101 | A1 | 5/2002 | |
| WO | 2005119585 | A1 | 12/2005 | |
| WO | 2015191619 | A1 | 12/2015 | |
| WO | 2017105289 | A1 | 6/2017 | |
| WO | 2017200390 | A1 | 11/2017 | |

OTHER PUBLICATIONS

European Patent Office, Extended European search report, Application No./Patent No. 19397506.7-1113, dated Aug. 22, 2019 (7 pp.).

* cited by examiner

SPRINKLER HEAD WITH A BULB HAVING AN EMBEDDED RFID CIRCUIT

CROSS-REFERENCE TO RELATED APPLICATIONS

This application claims the benefit of European Patent Application No. 19397506.7 filed Mar. 1, 2019, the disclosure of which is incorporated herein by reference in its entirety.

BACKGROUND

The present disclosure relates to fire sprinkler heads and more specifically to a fire sprinkler head with a bulb having an embedded RFID circuit.

Fire sprinklers may be equipped with bulbs that are frangible and which fragment when exposed to heat induced from a fire. Fire sprinklers may be equipped with tags having radio frequency identification (RFID) circuits that include RFID antennas. A monitoring system may communicate with the tags to identify and locate the fire sprinkler. Such monitoring may assist with identifying a location of a fire condition. Connections between the tags and the fire sprinkler may result in the tag detaching and falling way upon fragmentation of the bulb in the presence of a fire condition. Detaching of the tags may compromise an ability of the monitoring system to track a location of a fire.

BRIEF SUMMARY

Disclosed is a sprinkler head comprising: a sprinkler body; a frangible sprinkler bulb connected to the body, the frangible sprinkler bulb including: a cylindrical wall; and an RFID circuit embedded in the cylindrical wall.

In addition to one or more of the above disclosed features or as an alternate the RFID circuit includes an antenna and a microchip operationally connected to the antenna; the antenna extending between opposing axial ends of the cylindrical wall; and the microchip disposed axially mid-span of the opposing axial ends of the cylindrical wall.

In addition to one or more of the above disclosed features or as an alternate the opposing axial ends of the cylindrical wall include a first end and a second end; the antenna includes a first portion and a second portion; the first portion extending between the microchip and the first end of the cylindrical wall; and the second portion extending between the microchip and the second end of the cylindrical wall.

In addition to one or more of the above disclosed features or as an alternate the first portion of the antenna and the second portion of the antenna each comprise a periodic waveform pattern, each periodic waveform pattern propagating toward respective axial ends of the sprinkler bulb.

In addition to one or more of the above disclosed features or as an alternate each periodic waveform pattern is a square waveform.

In addition to one or more of the above disclosed features or as an alternate the cylindrical wall includes an inner surface and an outer surface, and the RFID circuit is embedded in one of the inner surface and the outer surface.

In addition to one or more of the above disclosed features or as an alternate the sprinkler head includes a mounting adaptor for connecting with a supply conduit.

In addition to one or more of the above disclosed features or as an alternate the sprinkler head includes a seal for fluidly isolating the bulb from the supply conduit.

Further disclosed is system comprising: the sprinkler head of In addition to one or more of the above disclosed features and a system controller, wherein the controller is configured for: communicating with the RFID circuit in the sprinkler head to obtain a status of the sprinkler head; and determining that a fire condition exists by identifying a communication break with the RFID circuit.

In addition to one or more of the above disclosed features or as an alternate the controller is configured for periodically communicating with the RFID circuit in the sprinkler head to obtain the status of the sprinkler head.

In addition to one or more of the above disclosed features or as an alternate the controller is configured for identifying a location of the RFID circuit, thereby identifying a location of the fire condition.

Disclosed is a method comprising of detecting a fire with a controller, comprising: communicating with an RFID circuit in a sprinkler head to obtain a status of the sprinkler head; and determining that a fire condition exists by identifying a communication break with the RFID circuit; wherein the sprinkler head comprises: a sprinkler body; a frangible sprinkler bulb connected to the body, the frangible sprinkler bulb including: a cylindrical wall; and the RFID circuit embedded in the cylindrical wall.

In addition to one or more of the above disclosed features or as an alternate the controller is configured for periodically communicating with the RFID circuit in the sprinkler head to obtain the status of the sprinkler head.

In addition to one or more of the above disclosed features or as an alternate the controller is configured for identifying a location of the RFID circuit, thereby identifying a location of the fire condition.

In addition to one or more of the above disclosed features or as an alternate the RFID circuit includes an antenna and a microchip operationally connected to the antenna; the antenna extending between opposing axial ends of the cylindrical wall; and the microchip disposed axially mid-span of the opposing axial ends of the cylindrical wall.

In addition to one or more of the above disclosed features or as an alternate the opposing axial ends of the cylindrical wall include a first end and a second end; the antenna includes a first portion and a second portion; the first portion extending between the microchip and the first end of the cylindrical wall; and the second portion extending between the microchip and the second end of the cylindrical wall.

In addition to one or more of the above disclosed features or as an alternate the first portion of the antenna and the second portion of the antenna each comprise a periodic waveform pattern, each periodic waveform pattern propagating toward respective axial ends of the sprinkler bulb.

In addition to one or more of the above disclosed features or as an alternate each periodic waveform pattern is a square waveform.

In addition to one or more of the above disclosed features or as an alternate the cylindrical wall includes an inner surface and an outer surface, and the RFID circuit is embedded in one of the inner surface and the outer surface.

In addition to one or more of the above disclosed features or as an alternate a mounting adaptor is provided for connecting with a supply conduit and a seal for fluidly isolating the bulb from the supply conduit.

BRIEF DESCRIPTION OF THE DRAWINGS

The present disclosure is illustrated by way of example and not limited in the accompanying figures in which like reference numerals indicate similar elements.

DETAILED DESCRIPTION

Figure 2:
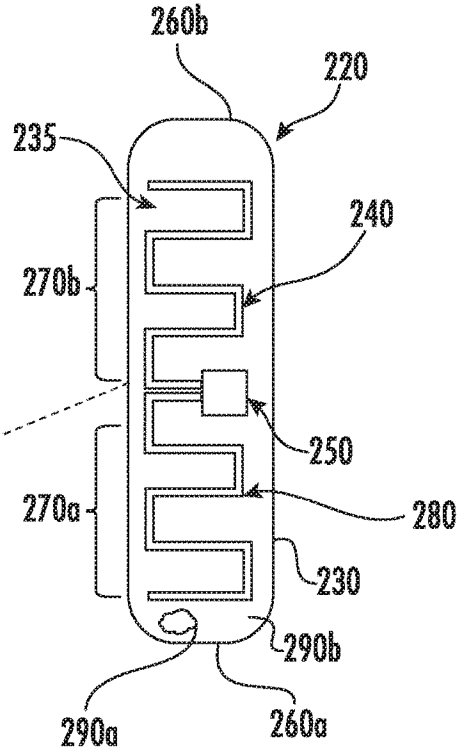
FIG. 2 illustrates a frangible bulb according to an embodiment.
Figure 1:
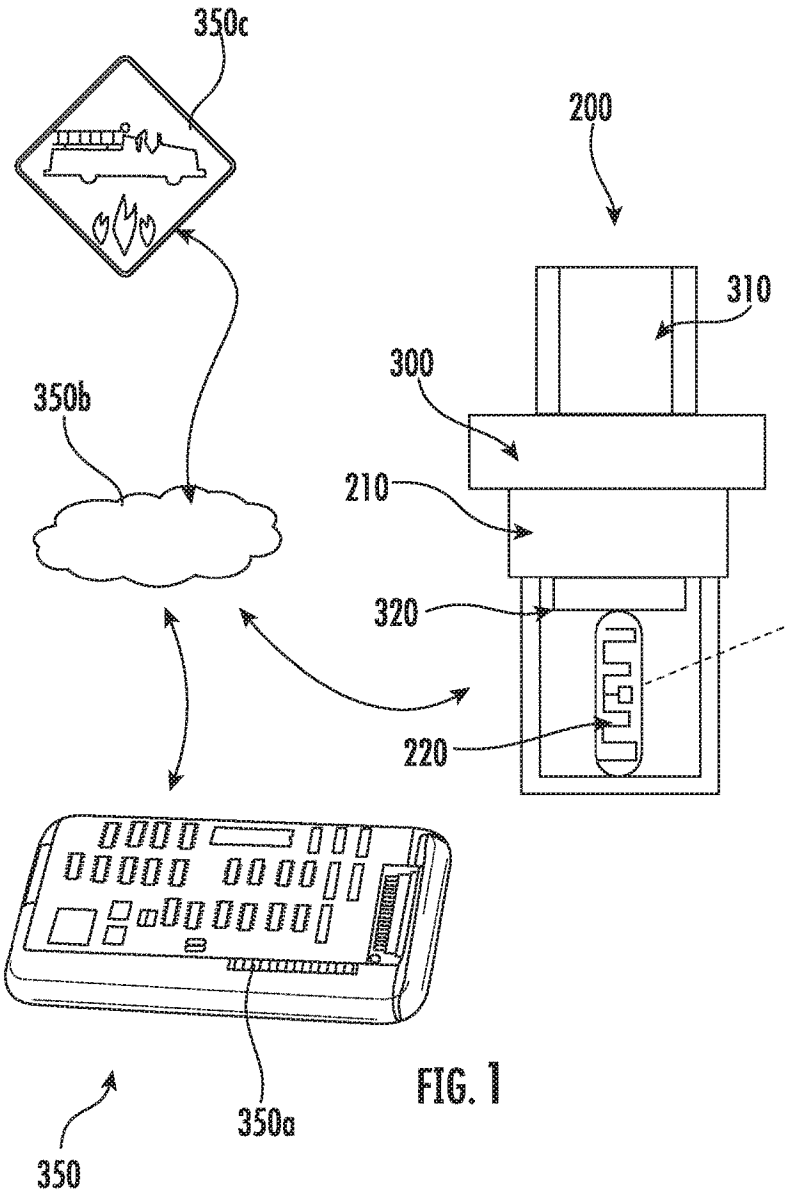
FIG. 1 illustrates a sprinkler head according to an embodiment.

Turning to FIGS. 1 and 2, disclosed is a sprinkler head 200. The sprinkler head 200 may comprise a sprinkler body 210 and a frangible sprinkler bulb 220 that may be connected to the body 210. The frangible sprinkler bulb 220 may include a cylindrical wall 235 and an RFID (radio frequency identification) circuit 230. The RFID circuit 230 may be embedded in the cylindrical wall 235.

The RFID circuit 230 may include an antenna 240 and a microchip 250 operationally connected to the antenna 240. The antenna 240 may extend between opposing axial ends generally referred to as 260 of the cylindrical wall 235. The microchip 250 may be disposed axially mid-span of the opposing axial ends 260 of the cylindrical wall 235.

The opposing axial ends 260 of the cylindrical wall 235 may include a first end 260*a* and a second end 260*b*. The antenna 240 may include a plurality of axially extending portions generally referenced as 270 including first portion 270*a* and a second portion 270*b*. The first portion 27*a* may extend between the microchip 250 and the first end 260*a* of the cylindrical wall 235. The second portion 270*b* may extend between the microchip 250 and the second end 260 of the cylindrical wall 235.

The first portion 270*a* of the antenna 240 and the second portion 270*b* of the antenna 240 may each comprise a periodic waveform pattern generally referenced as 280. The periodic waveform pattern 280 may propagate toward respective axial ends 260 of the sprinkler bulb 220. The periodic waveform pattern 280 may be a square waveform.

The cylindrical wall 235 may include a plurality of surfaces generally referenced as 290, including an inner surface 290*a* (illustrated schematically) and an outer surface 290*b*. The RFID circuit 230 may be embedded in one of the plurality of surfaces 290 so as to render the RFID circuit 230 tamper-proof, for example, relative to an RFID tag.

A mounting adaptor 300 may be provided for connecting the sprinkler head 200 with a supply conduit 310. A seal 320 may be provided for fluidly isolating the bulb 220 from the supply conduit 310.

The sprinkler head 200 may be part of a fire detection system generally referenced as 350, which may include a system controller 350*a* that may be configured to electronically communicate with the RFID circuit 230 over a network 350*b*.

Figure 3:
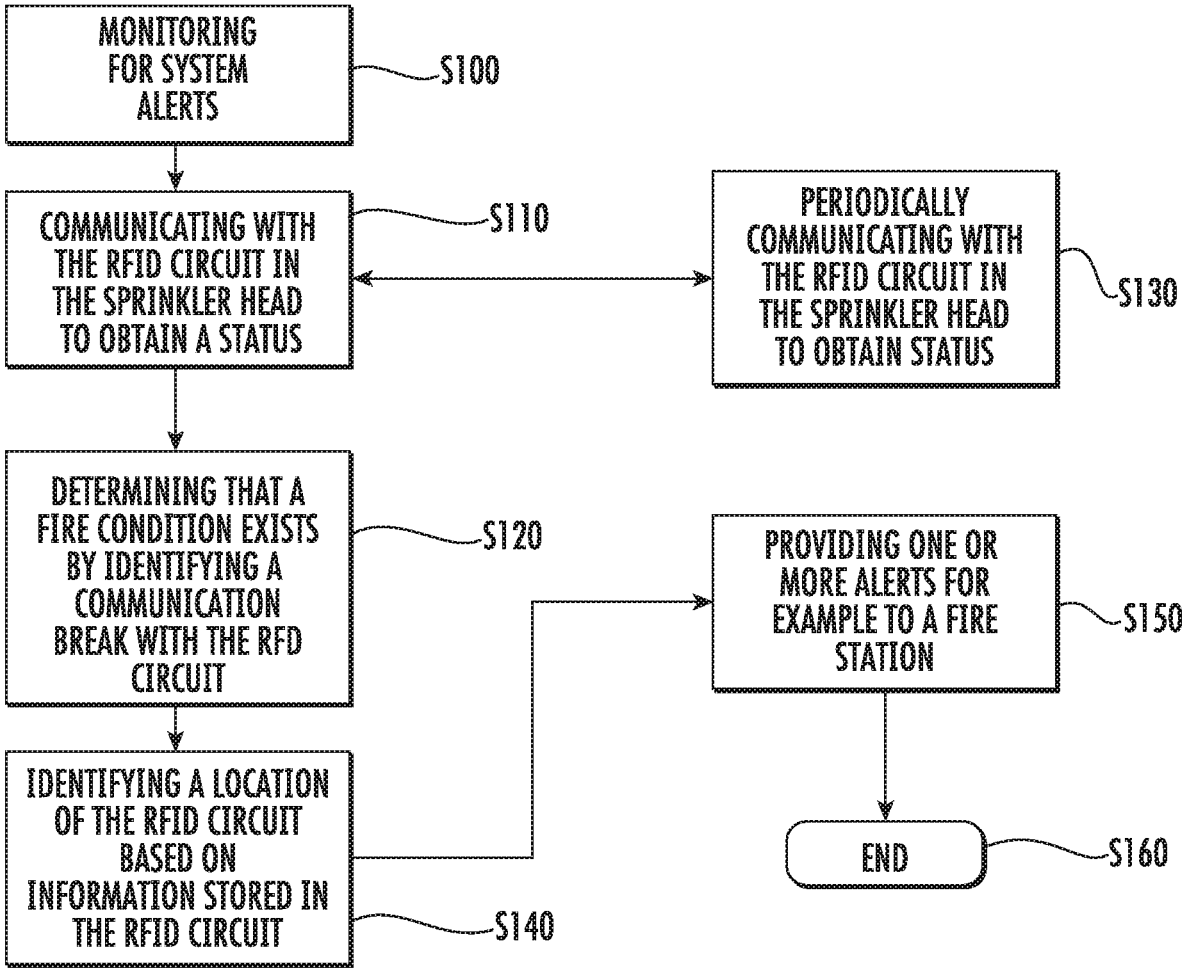
FIG. 3 illustrates a process for monitoring for a fire condition according to an embodiment.

Turning to FIG. 3, the controller 350*a* may be configured for performing step S100 of monitoring for system alerts. Step S100 may include step S110 of communicating with the RFID circuit 230 in the sprinkler head 200 to obtain a status of the sprinkler head 200. At step S120 the controller may perform the step of determining that a fire condition exists by identifying a communication break with the RFID circuit 230.

In an embodiment, step S110 of communicating with the RFID circuit 230 may include step S130 of the controller 350*a* periodically communicating with the RFID circuit 230 in the sprinkler head 200 to obtain the status of the sprinkler head 200. For example, the controller may communicate every second with the RFID circuit so that a fire situation is not missed. At step S140 the controller 350*a* may identify a location of the RFID circuit 230 based on information stored in the RFID circuit 230, thereby identifying a location of the fire condition. The controller 350*a* may at step S150 provide one or more alerts for example to a fire station 350*c* over the same network 350*b* or a different network. The alerts may include identifying a fire at a location of the sprinkler head 200. At step S160 the process that began at step S100 may end with respect to the sprinkler head 200.

The above disclosed embodiments further provide a method for detecting a fire. The method may include a monitoring system detecting a brake in the RFID antenna, which results from fragmentation of the bulb during a fire condition. The monitoring system may render a determination that a fire condition exists when it is unable to communicate with the RFID chip.

One benefit of the disclosed embodiments may include reducing manufacturing time and efforts for fire sprinklers that otherwise include frangible bulbs and RFID tags. Another benefit may include increasing a reliability of identifying a location of a fire. A reliability of a fire detection system may be unaffected by implementing the disclosed embodiments because modifications to the frangible bulb as provided herein are isolated from utilized water distribution implements. The bulbs disclosed herein may be tracked as soon as the bulbs are manufactured rather than having to be later equipped with a separate RFID tag. Additionally, the antenna may be embedded within a bulb surface utilizing low cost manufacturing processes.

Disclosed embodiments identify one or more controllers and circuits that may utilize processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

I claim:

1. A sprinkler head comprising:

a sprinkler body;

a frangible sprinkler bulb connected to the body, the frangible sprinkler bulb including:

a cylindrical wall; and an RFID circuit embedded in the cylindrical wall, wherein:

the RFID circuit includes an antenna and a microchip operationally connected to the antenna, wherein the microchip is configured to store information indicative of a location of the sprinkler head within a fire detection system;

the antenna extending between opposing axial ends of the cylindrical wall;

the microchip disposed axially mid-span of the opposing axial ends of the cylindrical wall;

the opposing axial ends of the cylindrical wall include a first end and a second end;

the antenna includes a first portion and a second portion;

the first portion extending between the microchip and the first end of the cylindrical wall;

the second portion extending between the microchip and the second end of the cylindrical wall;

the first portion of the antenna and the second portion of the antenna each comprise a periodic waveform pattern, each periodic waveform pattern propagating toward respective axial ends of the sprinkler bulb; and wherein the cylindrical wall includes an inner surface and an outer surface, and the RFID circuit is embedded in one of the inner surface and the outer surface so that the RFID circuit is tamperproof.

2. The sprinkler head of claim 1, wherein each periodic waveform pattern is a square waveform.

3. The sprinkler head of claim 1, further comprising a mounting adaptor for connecting with a supply conduit.

4. The sprinkler head of claim 3, further comprising a seal for fluidly isolating the bulb from the supply conduit.

5. A system comprising:

the sprinkler head of claim 4, a system controller, wherein the controller is configured for:

communicating with the RFID circuit in the sprinkler head to obtain a status of the sprinkler head; and determining that a fire condition exists by identifying a communication break with the RFID circuit.

6. The system of claim 5, wherein the controller is configured for periodically communicating with the RFID circuit in the sprinkler head to obtain the status of the sprinkler head.

7. The system of claim 6, wherein the controller is configured for identifying a location of the RFID circuit, thereby identifying a location of the fire condition.

8. A method comprising of detecting a fire with a controller, comprising:

communicating with an RFID circuit in a sprinkler head to obtain a status of the sprinkler head; and determining that a fire condition exists by identifying a communication break with the RFID circuit; wherein the sprinkler head comprises:

a sprinkler body;

a frangible sprinkler bulb connected to the body, the frangible sprinkler bulb including:

a cylindrical wall; and the RFID circuit embedded in the cylindrical wall, wherein:

the RFID circuit includes an antenna and a microchip operationally connected to the antenna, wherein the microchip is configured to store information indicative of a location of the sprinkler head within a fire detection system;

the antenna extending between opposing axial ends of the cylindrical wall;

the microchip disposed axially mid-span of the opposing axial ends of the cylindrical wall;

the opposing axial ends of the cylindrical wall include a first end and a second end;

the antenna includes a first portion and a second portion;

the first portion extending between the microchip and the first end of the cylindrical wall;

the second portion extending between the microchip and the second end of the cylindrical wall;

the first portion of the antenna and the second portion of the antenna each comprise a periodic waveform pattern, each periodic waveform pattern propagating toward respective axial ends of the sprinkler bulb; and wherein the cylindrical wall includes an inner surface and an outer surface, and the RFID circuit is embedded in one of the inner surface and the outer surface so that the RFID circuit is tamperproof.

9. The method of claim 8, wherein the controller is configured for periodically communicating with the RFID circuit in the sprinkler head to obtain the status of the sprinkler head.

10. The method of claim 9, wherein the controller is configured for identifying a location of the RFID circuit, thereby identifying a location of the fire condition.

11. The method of claim 8, wherein each periodic waveform pattern is a square waveform.

12. The method of claim 8, wherein the sprinkler head further comprises a mounting adaptor for connecting with a supply conduit and a seal for fluidly isolating the bulb from the supply conduit.

* * * * *